US005676379A

United States Patent [19]

Kicks

[11] Patent Number: 5,676,379

[45] Date of Patent: Oct. 14, 1997

[54] DARTBOARDS

[75] Inventor: Harry William Kicks, Suffolk, United Kingdom

[73] Assignee: Kulite Tungsten Corporation, Rutherford, N.J.

[21] Appl. No.: 730,203

[22] Filed: Oct. 15, 1996

Related U.S. Application Data

[63] Continuation of Ser. No. 598,891, Feb. 9, 1996, abandoned.

[30] Foreign Application Priority Data

Feb. 9, 1996 [GB] United Kingdom ..... 9502654

[51] Int. Cl.[6] ..... F41J 3/00

[52] U.S. Cl. ..... 273/403

[58] Field of Search ..... 273/403, 404, 273/408

[56] References Cited

U.S. PATENT DOCUMENTS

| | | | |
|---|---|---|---|
| 2,076,357 | 4/1937 | Tempest | 273/403 |
| 4,927,162 | 5/1990 | Kicks | 273/408 |
| 5,417,437 | 5/1995 | Coppard et al. | 273/403 |

FOREIGN PATENT DOCUMENTS

| | | |
|---|---|---|
| 981483 | 1/1965 | United Kingdom . |
| 2181067 | 4/1987 | United Kingdom . |

*Primary Examiner*—William H. Grieb
*Attorney, Agent, or Firm*—Plevy & Associates

[57] ABSTRACT

A dartboard has a frame with radially and circularly-extending bed-defining members which cross-over one another on the face of the dartboard. The members closer to the frame have notches in which the other members are secured.

16 Claims, 3 Drawing Sheets

Figure 1:
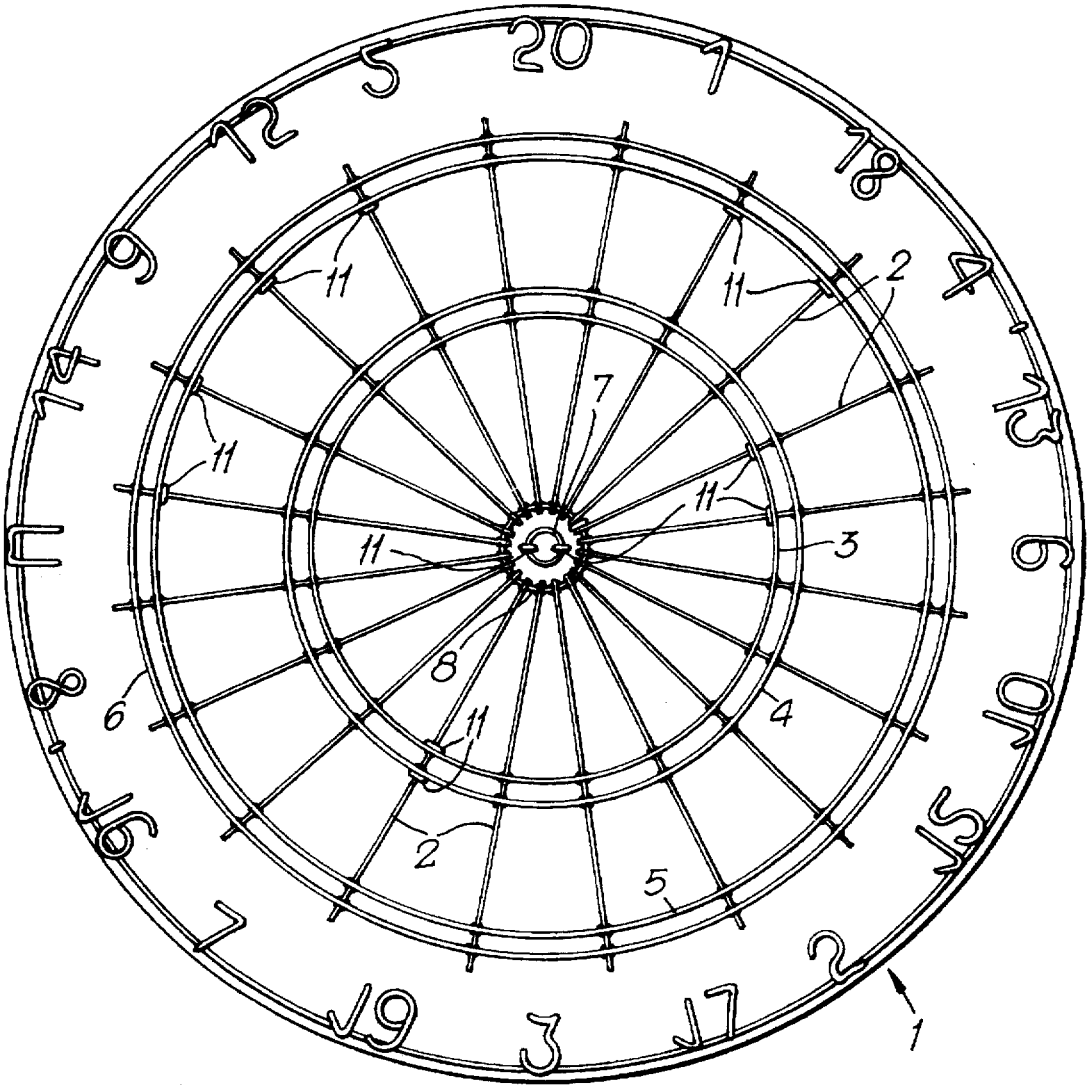

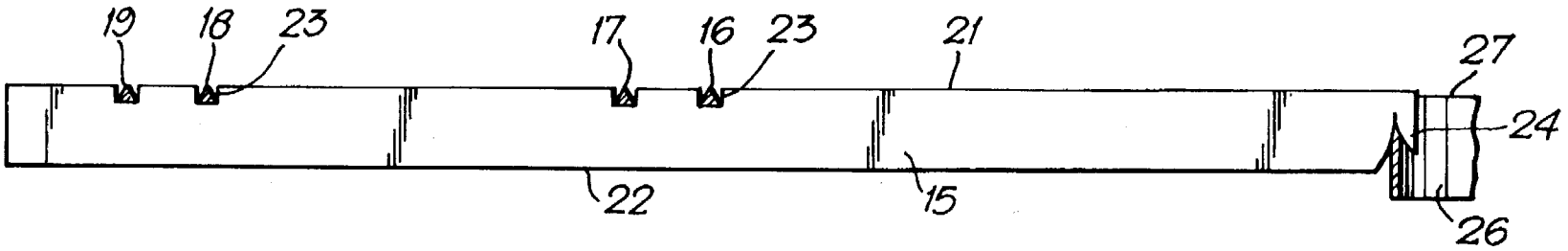
Fig.2.
Fig.4.
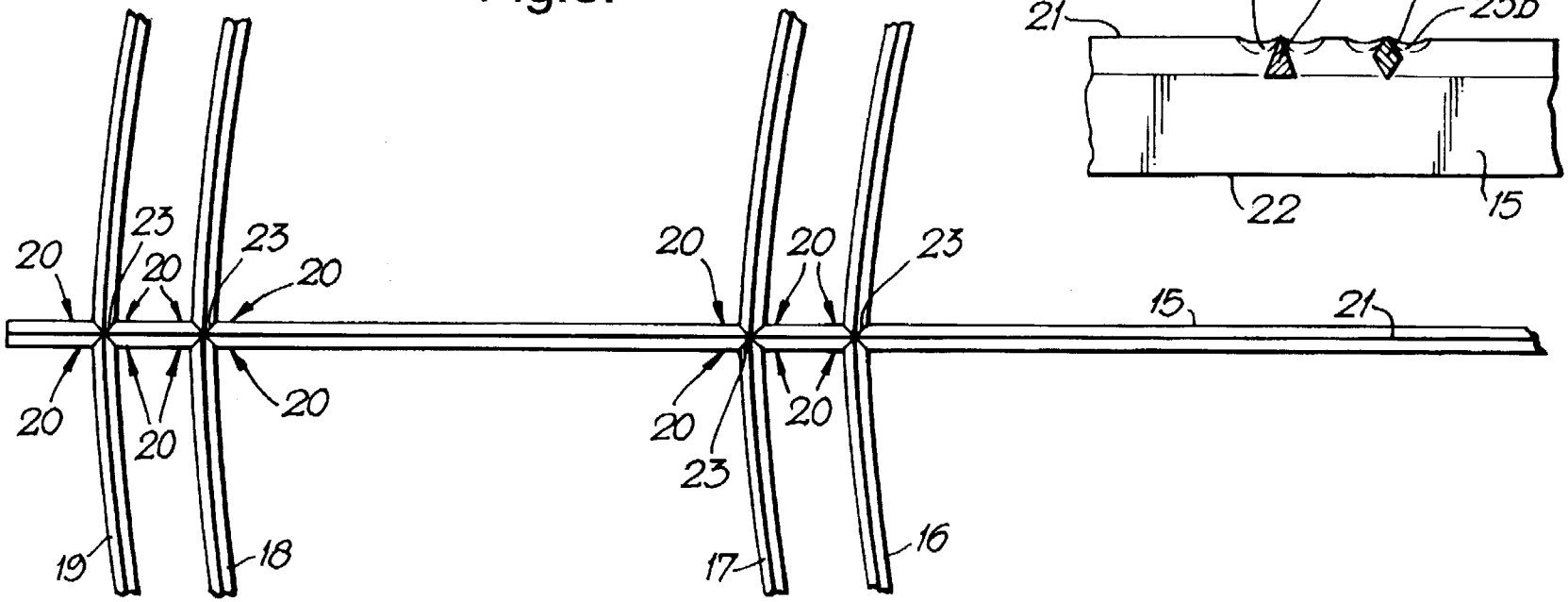
Fig.3.

DARTBOARDS

This is a continuation of application Ser. No. 08/598,891, filed on Feb. 9, 1996, entitled DARTBOARDS, now abandoned.

This invention relates to dartboards and to a method of manufacture of a dartboard.

Dartboards have a body made of a material which a dart is able to penetrate and be retained in, while allowing a player to remove the dart with comparative ease. The body of the board has a flat playing surface.

For the purposes of playing a game of darts, the flat surface of the board is divided into areas, known as beds, which are conventionally defined by wires placed on the surface of the board. The playing area on the surface is circular and is bounded by such a wire. The beds are defined by radially extending wires which extend from the boundary wire to a point near to the center of the playing circle. A dart which becomes embedded in a bed earns a number of "points" for a player according to the bed in which it is retained.

There are additionally on the surface of the dartboard narrow concentric areas, which are defined by parallel circularly-extending wires crossing each of the beds, resulting in small areas of each bed being distinguished from the main part of each bed. A dart which becomes embedded in one of these smaller areas earns for the player a multiple of the number of the "points" which are allocated to the particular bed.

The result of the number of cross-overs between the circularly extending and the radially-extending bed-defining wires, and of the use of staples, which are commonly employed to hold the wires in place, is that the surface of the board provides many obstructions to darts which land at the boundaries of the beds, and which are liable either to be trapped between a staple and a wire or between two wires at a cross-over, or to cause a dart to bounce off the board, without becoming embedded in it.

These problems have long been known. They were addressed in proposals set out in U.K. Patent No. 381,844 which was accepted on Oct. 13 1932, and U.K. Patent No. 406,400, which was accepted on Mar. 1 1934. In the first of these proposals, it was suggested that the bed-defining members be made as a single unit, referred to as a dial, and be attached to the surface of the dartboard via loops which extended outside the playing area. In the second of these proposals, it was suggested that the wire be fixed in position by cement, or by pins which passed through the wire, so that there were no flat or projecting points or depressions which the dart might strike.

In the specification of U.K. Patent No. 429,483, which was accepted on May 30 1935, a method of making a dartboard was suggested in which a sheet of woven fibrous material was rolled tightly into a cylinder and compressed before being wrapped in a metal tube. Further sheet woven fibrous material was then wrapped around the metal tube, compressed and the whole inserted into a second metal tube. The resulting "Swiss Roll" was sliced into pieces to form the bodies of the dartboards, and a complete dial defining the beds was soldered or spot welded to the ends of the tubes on the surface of a body.

The present invention enables a dartboard to be made which is comparatively simple to manufacture and which minimizes the likelihood of the problems mentioned above occurring.

The following description and accompanying drawings disclose a known arrangement, and, by means of an example, the invention for which protection is sought.

Figure 2A:
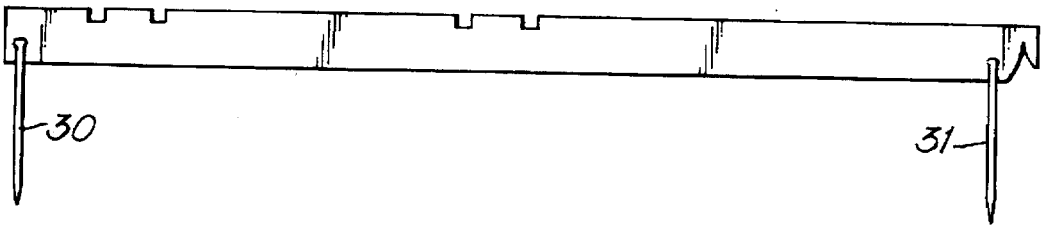
Figure 5:
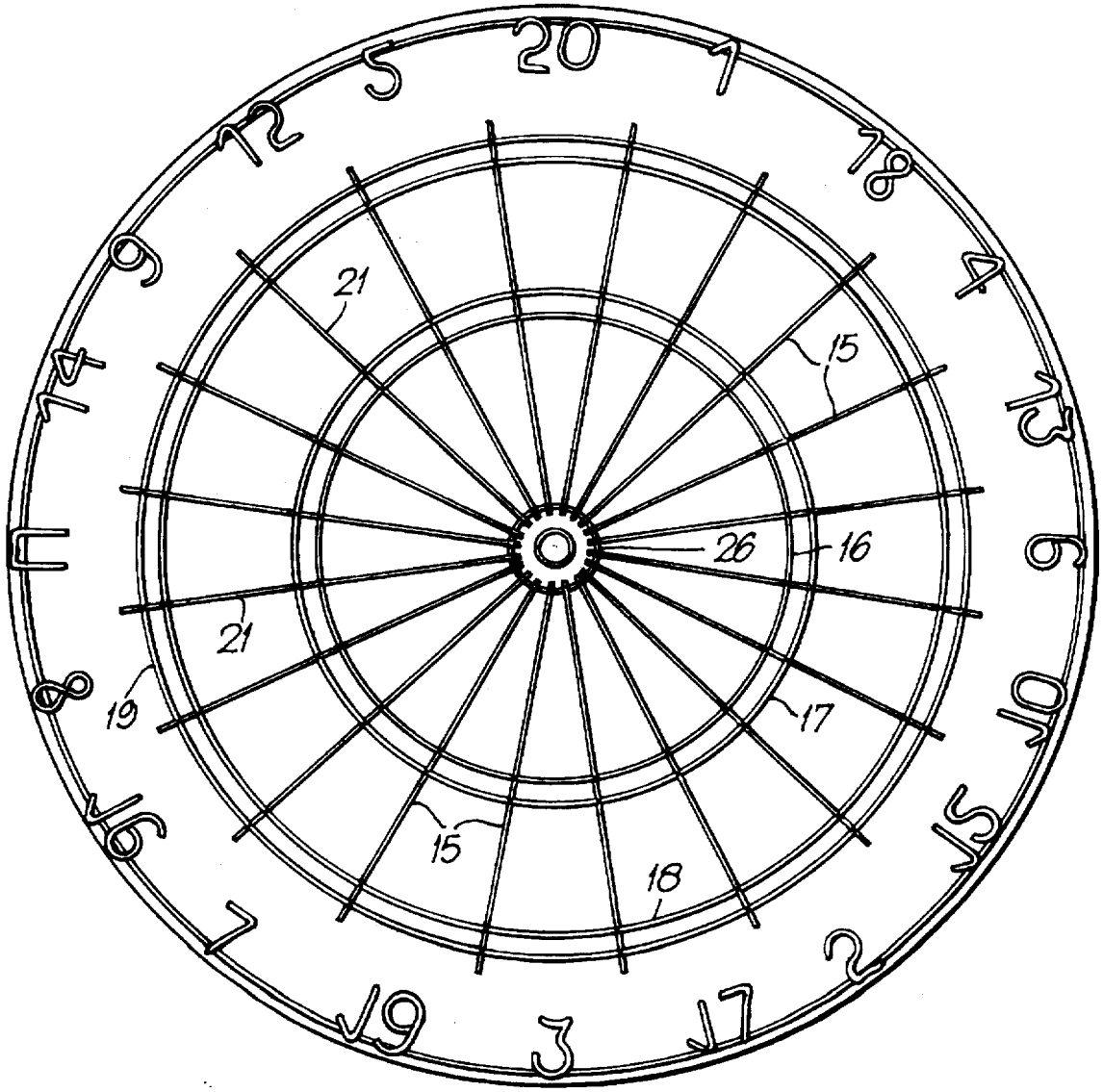

In the drawings:

FIG. 1 is a plan view of a known arrangement,

FIG. 2 is a side view of a radial member employed in carrying out the present invention, FIG. 2*a* is a side view of a modification of the radial member shown in FIG. 2, FIG. 3 is an enlargement of a part of a radial member, FIG. 4 is a plan view of a part of the radial member shown in FIGS. 2 and 3 and of parts of circularly extending wires held in the radial member, and FIG. 5 is a plan view of a dartboard employing the invention.

Referring to FIG. 1, there is shown a conventional dartboard having a body 1 of compressed sisal fibres. Fixed to the body there are radially-extending wires 2 defining sector-shaped playing areas, and circularly extending wires 3,4,5,6,7, and 8. The wires 3,4 define an annular area which intersects the radial wires and which is known as a "trebles" ring. Between the circularly-extending wires 5 and 6 there is defined a "doubles" ring area. The wires 7 and 8 together define a ring area known as an outer bull. The area within the wire 7 is known as an inner bull. A dart landing in one of these specially defined areas earns the player a higher number of points than if it were to land in any other part of a bed. When necessary, the wires are held to the board material by staples 11 of round wire. Usually, the staples are confined to holding down the radial wires adjacent to each of the circular wires 3,4 and 5 and possibly also 8.

Referring to FIGS. 2 to 5 there are illustrated parts of elements which are used in making a bed-defining frame employing the present invention. The parts shown in FIGS. 2 to 4 are a radially-extending member 15 and circularly extending wires 16,17, and 18,19.

The member 15 is one of a number of similar members which correspond to the wires 2 of FIG. 1. However, the member 15 is a flat stainless steel strip having bevelled opposite edges 21 and 22 along its length and notches 23 in the edge 21. At one end, the member 15 has a hook-like portion 24.

The circularly-extending wires 16,17 and 18,19, which are shown within respective notches 23 in the edge 21 of the strip member 15, correspond to the wires 3,4 and 5,6 of FIG. 1 and define the trebles and doubles rings on the dartboard.

In one arrangement, a ring 26 made from flat stainless steel strip and having its opposite edges bevelled, in a similar way to the strip 15, is used in correspondence to the wire ring 8 of FIG. 1 and cooperates with the hook-like portion 24 of member 18, as shown in FIG. 2. The edge 27 of the ring 26 may be notched, as required, to accommodate the strip 15.

The elements shown in FIGS. 2, 3 and 4 are assembled together so that they form a frame as shown in FIG. 5, which corresponds, in plan view, to the frame of FIG. 1. However, the circularly-extending wires 16,17,18, 19, which have a triangular cross-section in the embodiment being described, are held in the notches 23 by deforming the strip 15 around the notches 23 so that material from the strip 15 flows around the wires 16,17,18 and 19 and holds them in place. The hook-like portions 24 of each of the members 15 define a ring into which the stainless steel ring 26 fits. The ring 26 is held in place by deforming material from the hook-like portions 24 about the ring 26.

The tops of the wires 16,17,18 and 19 and the edges 21 of the strips 15 are at the same level.

In FIG. 2*a*, there is shown a modification of the strip 15 in which two pins 30 and 31 are welded to the radial strip 15. The pins 30 and 31 extend into the dartboard and enable a radial strip 15 of reduced width or depth to be held firmly in the material of the board.

In FIG. 4, there is shown a part of a strip 15 having notches 23*a* and 23*b* which, for the purposes of illustration, accommodate circularly-extending wires 17*a* and 16*a* of different cross sections. From FIG. 4 can be seen the way in which the wires 17*a* and 16*a* are held in position by squeezing material from radially-extending strip 15 around them, thus slightly distorting the upper edge 21 of the strip 15. The squeezing action is generally referred to as crimping. The strip is generally between 0.5 mm and 2 mm thick and of mild, carbon or stainless steel. The crimping may be on one or both sides of a notch and it need not be carried out at every notch.

In FIG. 3, arrows 20 indicate the application of pressure near to the edge 21 and on opposite sides of the strip 15 causing the side walls of the notches 23 to collapse about the wires 16,17 and 18,19 and to hold the wires firmly in position with respect to the strip 15.

In making a dartboard using a frame having the elements identified in FIGS. 2 to 4, the assembled frame is first placed so that the side of the frame having the edges 21 of the radially extending members and the tops of the wires 16,17,18 and 19 is against the base of a jig. A blank dartboard body is then placed with its painted and smooth face against the other side of the frame and the blank dartboard body is forced with considerable pressure against the edges 22 of the members 15 until the face of the body of the dartboard and the edges 21 of the members 15 are level.

In this way, the bed-defining members are firmly fixed in, as well as on, the face of the board without the need for staples. With the bed defining members firmly positioned within the face of the board the chances of a dart bouncing off a bed-defining member on the board are considerably reduced.

A radially extending strip acts as a foundation for the circularly-extending wires and inhibits any tendency of these wires to sink into the surface of the board which is commonly made of sisal, or to move or become distorted.

It will be appreciated that the elements may be formed and assembled in other ways than that described. For example, the radially-extending members could be wires and the circularly extending members could be made of flat strip material, suitably notched and crimped over the radially-extending members. The bed defining members might in a particular embodiment all be made from flat strip material suitably notched.

The strip material may be given an embossed or knurled surface pattern, or have prongs stamped out of its face in such a way that the pattern or the prongs allow the strip to be pressed into the board comparatively easily, while resisting any movement of the frame out of the board.

It will also be appreciated that a frame of the type described lends itself to use in the manufacture of a dartboard made from a molded plastics material which may be forced, or be allowed to flow, into the interstices of the frame as it is held in a jig or mold. Such a board of plastics material with metal bed-defining members embedded in its face has the considerable advantages described above.

Furthermore, although in the embodiment described, the circularly-extending and radially-extending elements are retained in recesses in one another by the distortion of the material of one or the other of them, they may alternatively or additionally be welded or glued together.

It is furthermore possible, where a radially-extending member is a strip, to notch or step it at its end remote from the center, in order to allow a fastener to be placed over the strip, but below a non-playing sisal surface.

Although the invention has been described, by means of an example, with reference to a particular embodiment, it will be appreciated from the above description that variations or modifications thereof may be made, as well as other arrangements employing the present invention.

I claim:

1. A dartboard comprising:

a disc-shaped dartboard body having a substantially flat playing surface;

radial bed-defining members having a top edge and a bottom edge, said bottom edge pressed into said dartboard body so said top edge is substantially level with said playing surface of said dartboard body, said radial bed-defining members extending radially outward from a point near the center of said dartboard body, said radial bed-defining members having notches on said top edge; and circular bed-defining members secured into said notches of said radial bed-defining members, wherein at least one of said notches of said radial bed-defining members is deformed around said circular bed-defining members by the crimping of the material forming the radial bed-defining members so that the material of said radial bed-defining members adjacent said at least one of said notches is squeezed to flow around said circular bed-defining member to secure said circular bed-defining member in said at least one of said notches.

2. The dartboard of claim 1 wherein said radial bed-defining members are formed from flat metal strips.

3. The dartboard of claim 1, wherein said circular bed-defining members are secured into at least one of said notches of said radial bed-defining members which are not deformed, by welding.

4. The dartboard of claim 1, wherein said circular bed-defining members have triangular cross section.

5. A dartboard having a playing surface, said dartboard comprising:

a frame having radially-extending and circularly-extending bed-defining members, wherein the radially-extending and circularly-extending members are secured together by one of the members being formed of a compressible material and having at least one notch, and the other of the members being pushed into the notch, the material forming the notched member being crimped adjacent the notch so that the sidewalls of the notch collapse about the member pushed into the notch and thereby hold the members firmly in place.

6. The dartboard of claim 5, wherein the members secured in the notches have a triangular cross-section.

7. The dartboard of claim 6, wherein the radially-extending bed-defining members have a top edge, a bottom edge, and two ends, and further comprising a plurality of notches disposed along an edge of each of the radially-extending bed-defining members so that the circularly-extending bed-defining members are pushed into the notches of the radially-extending members.

8. The dartboard of claim 7, further comprising at least one pin disposed at one end of the radially-extending bed-defining members at the edge opposite the notches for securing the members into the dartboard so that the radially-extending members may be fabricated of a reduced width or depth while being firmly held in the dartboard.

9. The dartboard of claim 7, wherein at least one of the circularly-extending bed-defining members comprises a ring for forming the inner or outer bull of the dartboard, and wherein a hook is disposed at one end of the radially-extending bed-defining members for securing the radially-extending members to the ring.

10. The dartboard of claim 9, wherein the material forming the radially-extending bed-defining members is crimped adjacent the hook so that the sidewalls of the hook compress about the ring and thereby secure the ring to the radially-extending members.

11. The dartboard of claim 6, wherein the circularly-extending bed-defining members have a top edge and a bottom edge, and further comprising a plurality of notches disposed along an edge of each of the circularly-extending bed-defining members so that the radially-extending bed-defining members are pushed into the notches of the circularly-extending members.

12. A dartboard comprising:

a disc-shaped dartboard body having a substantially flat playing surface;

a frame for defining beds in the dartboard body, the frame comprising:

radially-extending and circularly-extending bed-defining members, wherein at least one of the circularly-extending members comprises a ring for forming the inner or outer bull of the dartboard;

wherein the radially-extending members are comprised of flat strips of compressible material having a top edge; a bottom edge; two ends; a plurality of notches disposed along one edge of the members; a hook disposed at one end of the members for securing the members to the ring forming the bull; and two pins, one pin being disposed at each end of the radially-extending members for securing the members into the dartboard; and wherein the radially-extending and circularly-extending members are secured together by the circularly-extending members being pushed into the notches of the radially-extending members, by the hooks of the radially-extending members being placed about the ring, and by the material forming the radially-extending members being crimped adjacent the notches and adjacent the hooks so that the sidewalls of the notches and of the hooks collapse about the circularly-extending members and thereby hold the members firmly in place.

13. The dartboard of claim 12, wherein the frame further comprises the plurality of notches being disposed along the top edge of the radially-extending bed-defining members, and wherein the pins and the hooks extend from the bottom edge of the radially-extending members in the direction opposite the notches.

14. The dartboard of claim 13, wherein the circularly-extending members have a triangular cross-section.

15. The dartboard of claim 14, wherein the circularly-extending bed-defining members are fabricated with wire.

16. The dartboard of claim 15, wherein the frame is disposed within the dartboard body so that the top edge of the radially-extending members is substantially level with the playing surface of the dartboard.

* * * * *